United States Patent [19]

Heaney et al.

[11] Patent Number: 4,883,449

[45] **Date of Patent: * Nov. 28, 1989**

[54] DEVICE FOR MAKING GROOVES IN CIGARETTE FILTERS

[75] Inventors: Richard Heaney, Campbell; Erik I. Naslund, Los Gatos, both of Calif.

[73] Assignee: Brown & Williamson Tobacco Corporation, Louisville, Ky.

[ * ] Notice: The portion of the term of this patent subsequent to May 14, 2002 has been disclaimed.

[21] Appl. No.: 632,081

[22] Filed: Jul. 18, 1984

[51] Int. Cl.[4] ..... B29C 43/08; A24C 3/02; A24C 3/04

[52] U.S. Cl. ..... 493/43; 425/385; 425/392; 425/402; 279/1 E; 82/11; 131/94

[58] Field of Search ..... 493/42, 43, 44, 45, 493/46; 425/383, 384, 385, 392, 394, 397, 400, 402; 131/94; 72/423; 10/169; 279/1 E; 82/2.5, 31

[56] References Cited

U.S. PATENT DOCUMENTS

| | | | |
|---|---|---|---|
| 1,512,381 | 10/1924 | Turcott | 142/5 |
| 3,348,852 | 10/1967 | Wilson | 279/58 |
| 3,804,695 | 4/1974 | Randall et al. | 156/441 |
| 3,845,963 | 11/1974 | Price | 279/89 |
| 4,075,936 | 2/1978 | Berger | 493/43 |
| 4,149,546 | 4/1979 | Luke et al. | 131/94 |
| 4,292,032 | 9/1981 | Luke | 493/43 |
| 4,324,540 | 4/1982 | Sextone et al. | 425/385 |
| 4,436,517 | 3/1984 | Lebet | 493/45 |
| 4,492,238 | 1/1985 | Wheless | 131/94 |
| 4,517,046 | 5/1985 | Heaney et al. | 156/500 |

*Primary Examiner*—Francis S. Husar
*Assistant Examiner*—William E. Terrell
*Attorney, Agent, or Firm*—Charles G. Lamb

[57] ABSTRACT

An apparatus for sequentially forming a plurality of generally longitudinally extending grooves in the peripheral surface of a filter rod includes a hollow rotatable drum having a plurality of filter rod receiving channels formed in its outer peripheral surface for receiving filter rods to be grooved. The device includes filter rod indexing devices which engage the filter rods in the receiving channels. As the drum rotates about its central axis, the filter rod indexing devices are individually and selectively activated to incrementally rotate selected filter rods about their longitudinal axes through an angle corresponding to the angular spacing between adjacent grooves to be formed in the peripheral surface of the filter rod. Cam operated grooving fingers located around the circumference of the drum are selectively actuated to sequentially form grooves in the filter rods after the filter rods have been rotated about their longitudinal axes from the position of the previously formed groove by the filter rod indexing device.

20 Claims, 3 Drawing Sheets

DEVICE FOR MAKING GROOVES IN CIGARETTE FILTERS

BACKGROUND OF THE INVENTION

1. Field of the Invention

The present invention relates to the manufacture of filters for cigarettes and more particularly to the making of grooves in cigarette filters. In addition, the present invention relates to the making of apertures in the grooves at preselected locations.

2. Description of the Prior Art

Cigarettes are often provided with filter devices at one end to remove materials from the smoke stream coming from the tobacco column during smoking. These filters, which are attached to the tobacco column, come in many different sizes, shapes and forms. Some filters which are presently on the market include grooves. In some filter constructions, the grooves facilitate the by-passing of smoke around the filter. In other filter constructions, the grooves provide a channel for mixing ventilating air and by-passing smoke. In still other constructions, the grooves provide a path for only ventilating air to pass therealong without mixing with smoke.

In the manufacture of grooved cigarette filters, many suggestions have been made for making the grooves in the filter rod. U.S. Pat. No. 3,804,695 shows the use of a pair of parallel rollers in pressure engagement defining a nip therebetween wherein one of the rollers is provided with a circumferential or a helical grooved surface so that, as a filter rod passes therethrough, permanent depressions are made along the longitudinal dimensions of the filter rod. U.S. Pat. No. 4,075,936 shows a die having cam manipulated radially reciprocating pins that periodically move into and out of the longitudinal path of a filter rod as the filter rod tow moves past. When the pins extend into the path of the tow they impress grooves in the filter rod. U.S. Pat. No. 4,149,546 shows an apparatus for making grooves in a cigarette filter wherein a filter rod is moved in an arcuate path transverse to a heated forming means, the filter rod being supported and conveyed for relative movement at the periphery of a drum-shaped inner rotor and the forming means compresses a heated arcuate outer strator element or elements projecting inwardly toward the rotor. U.S. Pat. No. 4,324,540 teaches an apparatus for making grooves in filters which comprises a plurality of fixed position groove forming blades and a filter plug conveying device located next to the groove forming blades. Cigarette filters to be grooved are moved along the path between the conveyor device and blades, rolling past the blades whereupon grooves are formed in the filters by the blades.

SUMMARY OF THE INVENTION

The present invention provides an apparatus for making grooves in cigarette filter rods. The present invention further provides a device for concurrently forming a plurality of elongated grooves in the peripheral surface of a filter rod.

More particularly, the present invention provides an apparatus for making elongated grooves in the peripheral surface of a filter rod comprising a hollow, generally cylindrical, rotatable drum, means defining a plurality of filter rod receiving channels in the outer peripheral surface of the drum spaced apart about the perimeter of the drum, means for selectively indexing each of the filter rods in the channels through predetermined angle of rotation about the longitudinal axis of the filter rod; and means for forming at least one longitudinal groove in each of the filter rods in the channels as the drum rotates.

BRIEF DESCRIPTION OF THE DRAWINGS

A more complete understanding of the present invention will be obtained upon reference to the following description in conjunction with the accompanying drawings in which like numerals refer to like parts and wherein.

DESCRIPTION OF THE PREFERRED EMBODIMENTS

Figure 1:
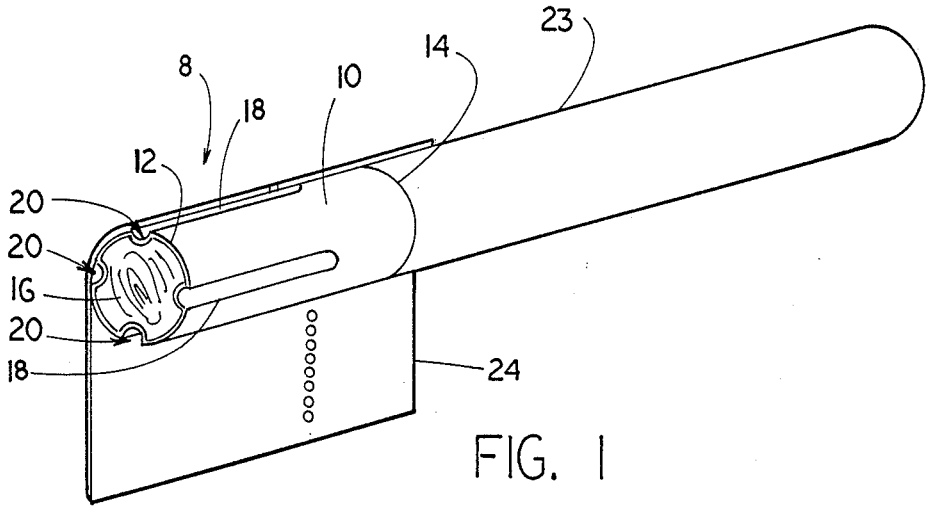
FIG. 1 is a perspective view of a cigarette having a representative filter rod attached thereto, the apparatus of the present invention being capable of manufacturing the filter rod.

Novel cigarette filters 8 of the type illustrated in FIG. 1 comprise a generally cylindrically shaped filter rod 10 fabricated of an air and smoke permeable material and a circumscribing wrapper 12 fabricated of an air and smoke impermeable material. The wrapper 12 extends longitudinally of the filter rod 10 from end 14 of the filter rod to the other end 16 thereof so that the filter rod ends 14 and 16 are in mutual flowthrough relationship. The filter 8 includes a plurality of grooves 18 formed in the wrapper 12 and embedded into the filter rod 10. Each of the grooves 18 is open, as designated by the number 20, at the mouth end 16 of the filter rod 10 and extends therefrom in a generally longitudinal direction of the filter rod 10 for a distance less than the length of the filter rod 10. The grooves 18 are illustrated as being four in number, and equally spaced from each other about the circumference of the filter rod 10. The filter rod 10 is attached to a tobacco column 23 by means of an air permeable tipping material 24 which circumscribes the filter rod 10 and overlaps a portion of the tobacco column 23 in a manner known in the art to form a filtered cigarette. The tipping material 24 is formed with perforations to allow ambient air to flow into the groove 18. In FIG. 1, the tipping material is shown in a partially unwrapped position to more clearly show details of the wrapped filter rod.

Figure 2:
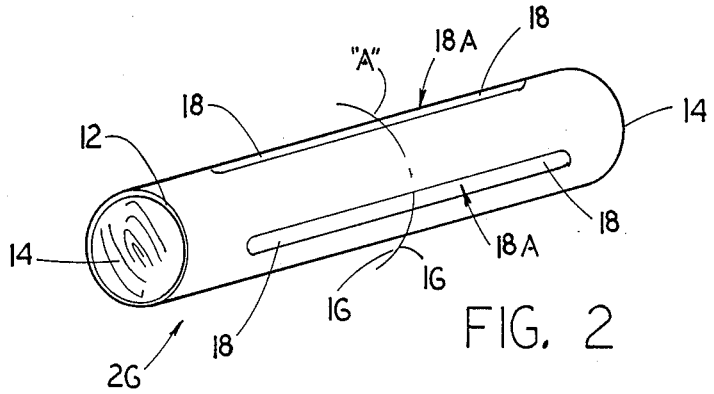
FIG. 2 is a perspective view of a filter tow from which the representative filter rod of FIG. 1 is made, and which the apparatus of the present invention is capable of manufacturing.

Now with reference to FIG. 2, as a manufacturing expedient, individual filter rods 10 are manufactured from a filter tow 26. The filter tow 26 is of a generally cylindrical shape and is as long as a preselected number of filter rods 10. As illustrated, the filter tow 26 is as long as two filter rods 10. The filter tow 26 is formed with longitudinally extending grooves 18A, each of which is twice as long as a groove 18 in the filter rod 10.

The illustrated filter tow 26 is severed, generally transversely to the longitudinal centerline of the filter tow 26 into individual filter rods 10. As illustrated, the filter tow 26 is severed at a location (denoted by the dashed line "A") at the transverse centerline of the double length grooves 18A. Thus, in the illustration of FIG. 2, two individual filter rods 10 are produced by severing the filter tow 26 at the dashed line A.

Figure 3:
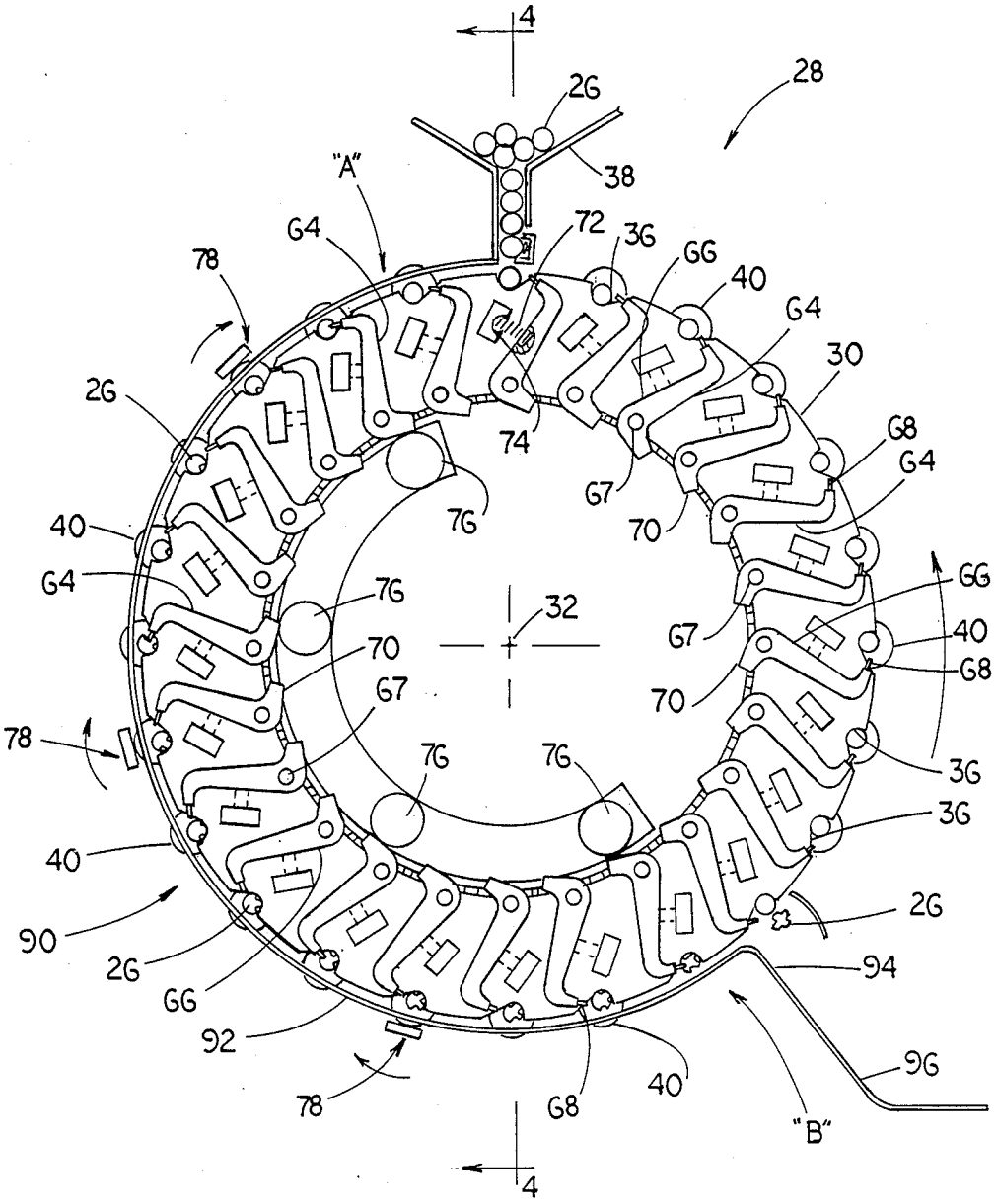
FIG. 3 is a sectional front view of an apparatus embodying the present invention as viewed in the direction of arrows 3—3 in FIG. 4.
Figure 4:
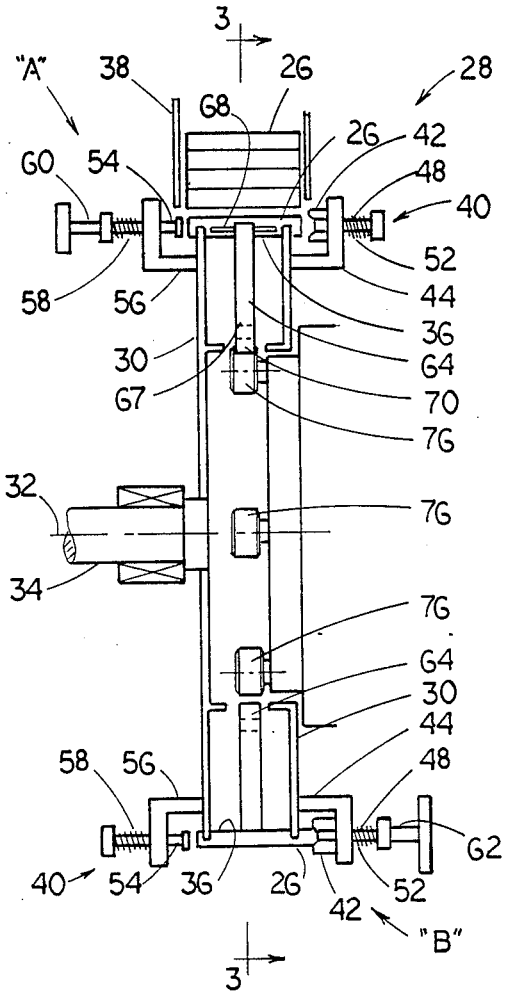
FIG. 4 is a sectional side view of the apparatus of FIG. 3 as viewed in the direction of arrows 4—4 in FIG. 3.

FIGS. 3 and 4 show a device, generally denoted as the numeral 28, for making the grooves 18 in the filter rod 10 of FIG. 1. For the reasons mentioned above, and as a further manufacturing expedient, the device 28 is adapted to form a plurality of double length grooves 18A in a filter tow 26 at one time in order to obtain a high rate of production. Therefore, the following discussion will speak to forming double length grooves 18A in the filter tow 26, but it should be clearly understood that the apparatus 28 could be just as readily used to form grooves 18 in individual filter filter rods 10 essentially without modification.

Referring to FIGS. 3 and 4, the groove making apparatus 28 comprises a hollow, generally cylindrical drum 30 adapted for rotation about its central axis 32. As shown, the drum 30 is vertically oriented with its rotational axis 32 in a horizontal plane. The drum 30 is adapted for rotation by means of, for example, a driven shaft 34 connected to the drum 30 coaxially with the rotational axis 32. The driven shaft 34 can be drivingly connected to a motor (not shown), and is preferably driven at a constant angular velocity. A plurality of filter tow receiving channels 36 are formed in the outer periphery of the drum 30 and are preferably in equally spaced apart relationship around the perimeter of the drum 30. The filter tow receiving channels 36 are open to the outer periphery of the drum 30 and are oriented with their longitudinal axis generally parallel to the axis of rotation of the drum 30. As can be best seen in FIG. 3, the channels 30 are tear drop shaped in transverse cross-section.

As shown, filter tow dispensing means, such as a hopper 38 is located adjacent to the outer peripheral surface of the drum 30 at the apex of the drum 30 for dispensing filter tow one at a time into the filter tow channels 36 as they sequentially move beneath the hopper 38.

Figure 5:
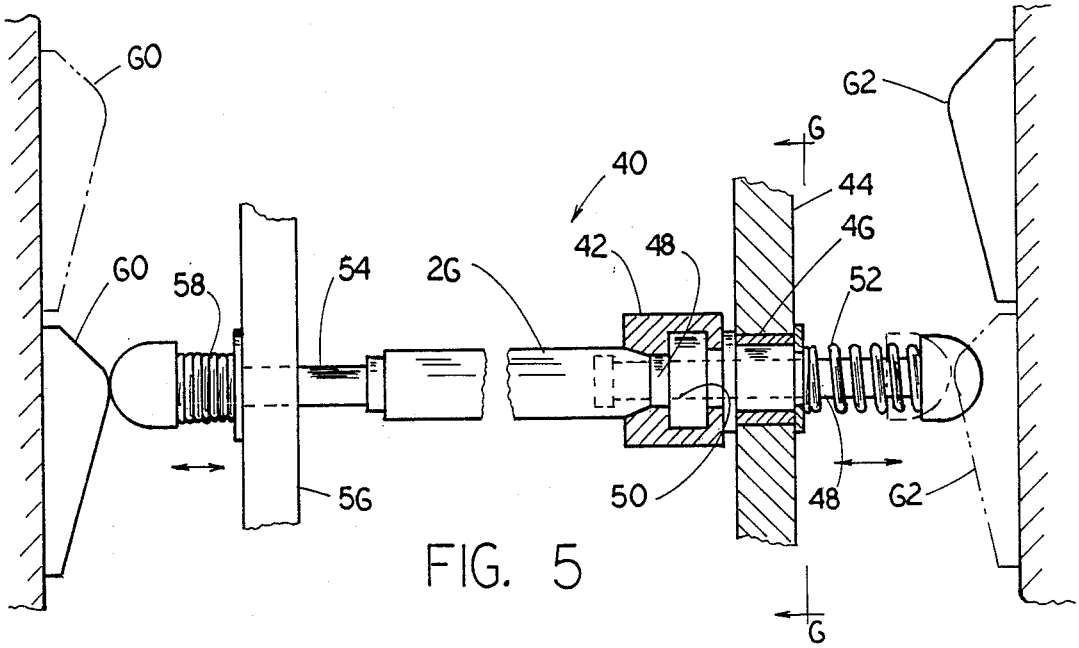
FIG. 5 is an enlarged cross-sectional view of a component of the apparatus of FIGS. 3 and 4; and, FIG. 6 is an enlarged view of another component of the apparatus of FIGS. 3 and 4.

With particular reference to FIGS. 3, 4 and 5, the apparatus 28 further includes means for selectively indexing each of the filter tows 26 located in the channels 36 through a predetermined angle of rotation about the longitudinal axis of the filter rod. The predetermined indexed angle corresponds to the angular displacement between adjacent grooves 18A to be formed in the peripheral surface of the filter tow 26. As can be best seen in FIG. 4, the indexing means comprises a plurality of indexing devices 40 affixed to the drum 30 for rotation with the drum. The number of indexing devices 40 is equal to the number of filter tow receiving channels 36, with a different one of the indexing devices 40 associated with each of the channels 36. As can be best seen in FIGS. 4 and 5, each indexing device 40 comprises a rotatable chuck 42 located to one side of the drum 30 and attached to the drum 30 by means of a bracket 44 in alignment with the filter tow receiving channel 36 for receiving one end of the filter tow 26 located in the channel 36. The chuck 42 is journalled in the bracket 44 by means of a bearing 46 so that the chuck 42 can rotate about its central axis. The chuck 42 further includes a filter rod ejector pin 48 coaxially located with the chuck 42 and mounted thereto through an aperture 50 for longitudinal movement into and out of the chuck 42. As shown, the ejector pin is biased in a direction out of the chuck 42 by, for example, a compression spring 52 located between the bracket 44 and the head of the ejector pin 48 extending to the opposite side of the bracket 44 from the chuck 42. The indexing device further includes a filter tow chucking pin 54 located to the other side of the drum 30 from the chuck 42 and attached to the drum 30, by means of a bracket 56, in longitudinal alignment with the filter tow receiving channel 36 for pushing a filter tow 26 longitudinally in the channel 36 into engagement with the chuck 42. As shown, the filter tow chucking pin 54 is coaxially located with the chuck 42 and is mounted to the bracket 56 for longitudinal movement into and out of the channel 36. As illustrated, the chucking pin 54 is biased in a direction out of the channel 36 by, for example, a compression spring 58 located between the bracket 56 and the head of the chucking pin 54 extending to the opposite side of the bracket 56 from the channel 36. With reference to FIGS. 3, 4 and 5, the filter tow chucking pin 54 is caused to move longitudinally into the aligned channel 36 in a zone of rotation "A" just downstream, relative to the direction of rotation of the drum 30, from the hopper 38 by, for example, a stationary cam 60. As the drum 30 rotates, the head of successive filter tow chucking pins 54 contact the cam 60 which pushes the chucking pin 54 longitudinally against the biasing force of the spring 58 into the channel 36. As the chucking pin 54 moves into the channel, it contacts the end of a filter tow 26 in the channel 36 and pushes the filter tow 26 along the channel 36 forcing the other end of the filter tow 26 into engagement in the chuck 42 located to the other side of the drum 30 from the chucking pin 54. As the drum 30 continues to rotate past the zone "A" the chucking pin 54 passes the cam 60 the biasing force of the compression spring 58 causes the chucking pin 54 to move longitudinally back out of the channel 36. With continued reference to FIGS. 3, 4 and 5, the filter rod ejector pin 48 is caused to move longitudinally into the chuck 42 in a zone "B" downstream, relative to the direction of rotation of the drum 30, from the zone "A" by, for example, a stationary cam 62. As the drum 30 rotates, the head of the filter rod ejector pin 48 contacts the cam 62 which pushes the ejector pin 48 longitudinally against the biasing force of the spring 52 into the chuck 42. As the ejector pin 48 moves into the chuck 42, it contacts the end of the filter tow 26 engaged in the chuck 42 forcing the end of the filter tow out of the chuck 42 in preparation to unloading the filter tow 26 from the groove making apparatus 28. As the drum 30 continues to rotate past the zone "B" the ejector pin 48 passes the cam 62 and the biasing spring 52 causes the ejector pin 48 to move longitudinally out of the chuck 42.

Figure 6:
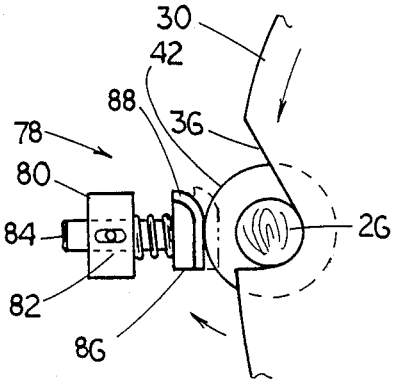

As can be best seen in FIGS. 3 and 4, the groove making apparatus further includes a plurality of groove forming devices 64 affixed to the drum 30 for rotation with the drum 30. The number of groove forming devices 64 is equal to the number of filter tow receiving channels 36, with a different one of the grove forming devices 64 associated with each of the channels 36. Each groove forming device 64 comprises an arm 66 extending in length generally from the channel 36 at the outer peripheral surface of the drum 30 to generally the inner peripheral surface of the drum 30. The arm 66 is pivotally mounted between its ends to the drum 30 with the pivotal axis 67 being generally parallel to the axis of rotation of the drum 30 so that the end of the arm 66 at the channel 36 is moveable toward and away from the filter rod in the channel 36 as the arm 66 pivots. The end of the arm 66 at the channel 36 is formed with an elongated groove forming blade 68. The groove forming blade 68 is as long s a double length groove 18A to be formed in the filter tow 26 and is generally parallel to the longitudinal centerline of the channel 36. The other end of the arm 66 extends beyond the inner peripheral surface of the drum 30 generally radially of the drum 30. The extending end of the arm 66 forms a cam 70. The arm 66 is biased to a pivoted position such that the groove forming blade 68 is moved away from the channel 36 and more particularly away from the filter tow in the channel 36. Toward this end, a compression spring 72 is located in an appropriate spring pocket 74 formed in the drum 30 and in abuttment with the arm 66. As shown, the arms 66 are successively caused to pivot about the pivot axis 67 toward the filter rod in the channel 36 by means of stationary cam followers 76 located at spaced apart intervals along the inner peripheral surface of the drum 30 between the previously discussed zones "A" and "B". The number of cam followers 76 corresponds to the number of times that each arm 66 will be actuated toward the filter tow in the channel 36 and, therefore, to the number of grooves 18A to be formed around the perimeter of the filter tow 26. As illustrated, there are to be four grooves formed in the peripheral surface of each filter tow equally spaced apart circumferentially of the filter tow and, therefore, there are four successively located cam followers 76 located at appropriate intervals. As the drum 30 rotates, the cam 70 at the end of each arm 66 successively contacts successively located cam followers 76 causing each arm 66 in turn to pivot about its pivotal axis 67 moving the groove forming blade 68 toward the filter tow 26 in the channel 36. As the arms 66 move past the cam followers 76, the spring 72 moves the arms in the other pivotal direction moving the groove forming blade away from the now grooved filter tow in the channel 36. In order to form the four circumferentially spaced apart grooves in the filter rods in the channels 36, the filter rods must be indexed or rotated about their longitudinal axes through the appropriate angle. As illustrated, in order to form four equally spaced apart grooves in each filter tow, the filter tow must be angularly displaced 90° after each groove 18A is formed therein by the groove forming blades 68 of the arms 66 and before the next groove 18A is formed therein. Toward this end, the chuck 42 engaging one end of the filter tow 26 is caused to rotate through the desired angle, for example here 90°, thus rotating or indexing the engaged filter tow through the same angle about its longitudinal axis. In order to rotate the chuck 42, the indexing device 40 includes a plurality of stationary chuck contact shoe assemblies 78 adjacent to the outer periphery of the drum and at spaced apart intervals between the above discussed zones ¢A" and "B". As shown best in FIG. 3, there are three successively located shoe assemblies 78 so that each filter rod is indexed three times, and each time it is indexed through 90°. Each shoe assembly 78 is located between different pairs of adjacently located cam followers 76 to index the filter tows between successive groove forming operations. As can be best seen in FIG. 6, each shoe assembly 78 comprises a mounting bracket 80, attached to appropriate framework (not shown), having a through bore 82. A longitudinally movable shaft 84 is axially received in the bore 82, and a chuck contact shoe 86 is attached to one end of the shaft 84 for movement toward and away from the outer periphery of the drum 30 with the shaft 84. A compression spring 88 is coaxially received over the shaft 84 between the bracket 80 and shoe 86 to bias the shoe 86 toward the outer periphery of the drum 30. The shoe 86 includes a friction sole 88 which contacts the periphery of the chuck 42 as the drum 30 rotates causing the chuck 42 to rotate in its journal mounting. The rotation of the chuck 42 indexes the filter tow 26 engaged therein, as discussed above, in preparation for following on grooving operations.

The groove making apparatus 28 further includes retaining means, generally denoted as the number 90, for retaining the filter tows in the channels 36 as the drum 30 rotates. As can be best seen in FIG. 4, the retaining means 90 is illustrated as comprising a stationary band 92 extending around a portion of the outer periphery of the drum 30, in the direction of rotation of the drum 30, from the hopper 38 to a location downstream of the zone "B" discussed above. The terminating end 94 of the band 92 downstream of the "B" defines the filter tow unloading station of the groove making apparatus 28. The band 92 is spaced radially from the outer periphery of the drum 30 by a distance less than the diameter of a filter tow. More particularly, the band 92 is spaced from the bottom of the filter rod receiving channels 36 by a distance slightly larger than the diameter of a filter tow so that the band 92 will keep the filter tow from falling out of the channel 36 as the drum 30 rotates, but will allow the filter tows to index about their longitudinal axes in the channels 36. As the drum 30 rotates, as the channels 36 containing a filter tow reach the terminal end 94 of the band 92, the filter tows fall out of the channels 36 under the influence of gravity. As shown, a chute 96 is located at the terminal end 94 of the band 92 to convey the grooved filter tow falling from the drum 30 away from the apparatus 28. Alternatively, it is contemplated that the retaining means 90 can comprise small apertures formed in the walls of the chamber 36 connected to a vacuum source so that the filter tows would be held in the channels 36 by suction.

It is also forseeable that the groove forming blades 68 can be heated by, for example, electrical resistance heating means if the material of the filter tow 26 has such a high modulus of elasticity that it will not take a permanent set when the blades 68 are implanted in the peripheral surface of the filter tow 26.

In the appended claims, the term filter rod is used in a generic sense to mean individual filter rods of filter tows from which individual filter rods are cut as discussed above in relationship to FIGS. 1–2.

The foregoing detailed description is given primarily for clearness of understanding and no unnecessary limitations should be understood therefrom for modifications will become obvious to those skilled in the art upon reading this disclosure and can be made without departing from the spirit of the invention or scope of the appended claims.

What is claimed is:

1. An apparatus for making elongated grooves in the peripheral surface of a filter rod, comprising:

a generally cylindrical, rotatable drum;

means for rotating the drum operatively associated therewith;

means defining a plurality of filter rod receiving channels in the peripheral surface of the drum, the filter rod receiving channels being open to the peripheral surface of the drum, the longitudinal axes of the channels being generally parallel to the rotational axis of the drum; means operatively positioned relative to said channels for depositing filter rods to be grooved in the channels; means for successively forming grooves in the peripheral surface of the filter rods while the filter rods remain disposed in the channels, the groove forming means being located adjacent each of the filter rod receiving channels and selectively movable into and out of the channels, the grooves being circumferentially spaced apart around the periphery of the filter rod; and, means associated with said drum for indexing filter rods relative to the rotation of the drum in selected ones of the channels while the filter rods remain in the filter rod receiving channels about the longitudinal axes of the filter rods to position the filter rods for succeeding groove formation by the groove forming means as the drum continues to rotate.

2. The groove making apparatus of claim 1, further comprising means for retaining the filter rods in the channels as the drum rotates.

3. The groove making apparatus of claim 1, wherein the means for successively forming a plurality of grooves in the filter rod comprises:

a plurality of arms pivotally attached to the drum, at least one arm being located at each one of the channels;

means for moving the arms about their pivots; and, groove forming blade means associated with each arm for movement therewith toward and away from a filter rod located in the channels.

4. The groove making apparatus of claim 3, wherein the means for successively forming a plurality of grooves in the filter rod comprises cam means for causing selected arms to pivot in a direction moving the groove forming blade means associated therewith toward a filter rod in the channel.

5. The groove making apparatus of claim 3, wherein the arms are biased to pivot in a direction moving the groove forming blade means associated therewith away from a filter rod in the channel.

6. The groove making apparatus of claim 1, wherein the filter rod indexing means comprises chuck means for holding at least one end of the filter rods in the channels as the filter rods index in the channels while the filter rods remain in the receiving channels.

7. The groove making apparatus of claim 6, wherein the filter rod indexing means further comprises means for rotating selected chuck means through a predetermined angle about the axis of the chuck means.

8. The apparatus of claim 7, wherein the means for rotating selected chuck means comprises stationary chuck contact means located at predetermined intervals about the perimeter of the drum for contacting chuck means as the rotating drum moves the chuck means past the chuck contact means.

9. The apparatus of claim 8, wherein the chuck contact means are adapted to contact the periphery of the chuck means.

10. The apparatus of claim 8, wherein the number of chuck contact means is equal to one less than the number of grooves to be formed in the filter rod.

11. The groove making apparatus of claim 6, wherein the filter rod indexing means further comprises means for forcing the filter rods in the channels into engagement with the chuck means.

12. The apparatus of claim 11, wherein the means for forcing the filter rod into engagement with the chuck means comprises a pin longitudinally movable toward and away from the chuck means.

13. The apparatus of claim 12, wherein the means for forcing the filter rod into engagement with the chuck means further comprises stationary cam means located at a predetermined location around the perimeter of the drum adapted to contact the pin and force the pin to move longitudinally toward the chuck means.

14. The apparatus of claim 13, wherein the pin is spring biased in a direction away from the chuck means.

15. The groove making apparatus of claim 6, wherein the indexing means comprises ejector means for ejecting grooved filter rods from the chuck means.

16. The apparatus of claim 15, wherein the ejector means comprises a pin longitudinally movable into and out of the chuck means.

17. The apparatus of claim 16, wherein the ejector means further comprises stationary cam means located at a predetermined location around the perimeter of the drum adapted to contact the pin and force the pin into the chuck means.

18. The apparatus of claim 17, wherein the pin is spring biased in a direction out of the chuck means.

19. The groove making apparatus of claim 2, wherein the filter rod retaining means comprises band means extending around at least a portion of the perimeter of the drum and spaced from the peripheral surface of the drum bottom of the filter rod receiving channels by a distance slightly larger than the diameter of the filter rods in the channels.

20. The groove making apparatus of claim 1, wherein the means for depositing a filter rod in the channels deposits a filter rod in each channel as the drum rotates sequentially moving each channel past the filter rod depositing means.

* * * * *